US012427390B1

(12) United States Patent
Vihlen

(10) Patent No.: US 12,427,390 B1
(45) Date of Patent: Sep. 30, 2025

(54) GOLF SWING TRAINING DEVICE

(71) Applicant: David Vihlen, Homestead, FL (US)

(72) Inventor: David Vihlen, Homestead, FL (US)

( * ) Notice: Subject to any disclaimer, the term of this patent is extended or adjusted under 35 U.S.C. 154(b) by 126 days.

(21) Appl. No.: 17/986,923

(22) Filed: Nov. 15, 2022

Related U.S. Application Data

(60) Provisional application No. 63/307,245, filed on Feb. 7, 2022.

(51) Int. Cl.
*A63B 69/36* (2006.01)

(52) U.S. Cl.
CPC ..... *A63B 69/3632* (2013.01)

(58) Field of Classification Search
CPC ..... A63B 69/3632
USPC ..... 473/207, 212, 213, 226, 227, 256, 268, 473/275, 201, 206
See application file for complete search history.

(56) References Cited

U.S. PATENT DOCUMENTS 2,484,762 A 10/1949 Strazza
2,928,678 A 3/1960 Cutting
3,459,426 A * 8/1969 Wiley ..... A63B 53/007 D21/756
4,065,127 A 12/1977 Fagan
4,361,326 A 11/1982 Kokes
4,576,378 A * 3/1986 Backus ..... A63B 21/00069 473/228
5,156,399 A 10/1992 Gauer
5,437,449 A * 8/1995 Zink ..... A63B 55/10 473/286
5,478,083 A * 12/1995 Foster ..... A63B 69/3685 473/226
5,795,241 A * 8/1998 Peshek ..... A63B 60/20 473/201
5,851,156 A * 12/1998 Schwark, Jr. ..... A63B 69/3632 473/238
6,251,025 B1 6/2001 Brock et al.
6,656,054 B2 12/2003 Ulrich
6,656,056 B1 12/2003 Leonard
6,881,155 B2 4/2005 Rohan-Weaver
6,923,727 B1 8/2005 Jacobs
8,414,415 B1 * 4/2013 Twohig ..... A63B 55/10 473/282
8,603,024 B2 12/2013 Bohm et al.
10,702,754 B2 7/2020 Ianazone

* cited by examiner

*Primary Examiner* — Nini F Legesse
(74) *Attorney, Agent, or Firm* — John Rizvi; John Rizvi, P.A.—The Patent Professor®

(57) ABSTRACT

A golf swing training device that is attachable to a golf club is described. The golf swing training device comprises a front surface and an opposite back surface. The front surface is a planar surface and allows a user to place a hand flush against the front surface. The back surface is coupled with at least one clip. The at least one clip protrudes from the back surface. The at least one clip comprises a flange portion and an arcuate portion. The arcuate portion is arranged to grip a golf club at a suitable position of the golf club, thus attaching the golf swing training device to the golf club. The golf swing training device when attached to the golf club allows a user to maintain a proper swing orientation and produce a straight swing, thereby preventing slicing of a golf ball.

17 Claims, 5 Drawing Sheets

GOLF SWING TRAINING DEVICE

FIELD OF THE INVENTION

The present invention relates generally to devices attachable to golf clubs, and more particularly to a device attachable to a golf club to facilitate proper swinging of the golf club.

BACKGROUND OF THE INVENTION

Golf is quite a challenging sport, partly because even slight variations in technique, body alignment or motion, and speed of a golf club become significant over the ball-hitting distances generally involved, making it extremely difficult to consistently hit a golf ball to a desired location.

To hit the golf ball to the desired location or over the desired distance, a golfer needs a striking face of a golf club head to hit the golf ball in an optimum manner (e.g., at the right position and at the right point in time). However, it is difficult, even for skilled professional golfers, to exactly know the time at which the striking face will hit the golf ball. Therefore, many golfers encounter hook and slice shots.

A hook shot is a shot in which a golf ball curves from the right to the left (for a right-handed golfer or golfer who has a dominant right hand) or from left to right (for a left-handed golfer or golfer who has a dominant left hand) due to a counterclockwise rotation of the ball, and frequently occurs in case where a golf club head hits the golf ball while moving from the inside to the outside when an impact is generated due to the golfer's swing motion.

On the other hand, for a right-handed golfer, a slice shot is a shot in which the golf ball curves to the right, whereas, for a left-handed golfer, a slice shot is a shot in which the golf ball curves to the left. In other words, the slice shot is the opposite of a hook shot. Generally, a slice shot is caused by the striking face of the golf club head arriving at impact with the golf ball in an open position. This may be due to setup or swing issues (associated with a golfer) that cause the striking face to open, or to an outside-to-inside swing path that effectively opens the striking face by "wiping" or "swiping" across the golf ball, imparting "slice spin" (a clockwise sidespin for right-handed golfers, and a counterclockwise sidespin for left-handed golfers).

To reduce occurrence of hook or slice shots, many golfers make efforts through posture correction devices and various other methods such as by using customized golf clubs. However, such posture-correcting devices and customized golf clubs are expensive, and do not succeed in preventing occurrence of the hook or slice shot.

Accordingly, there exists a need for a solution to at least some of the aforementioned problems. For instance, there is an established need for a device or an apparatus that prevents occurrence of a slice shot for a golfer.

SUMMARY OF THE INVENTION

The present invention relates to a golf swing training device that is attachable to a golf club. The golf swing training device comprises a front surface and an opposite back surface. The front surface allows a user to place a hand flush against the front surface, the hand being a dominant hand of the user. The back surface is coupled with at least one clip. The at least one clip protrudes from the back surface. The at least one clip comprises a flange portion and an arcuate portion. The arcuate portion is arranged to grip a golf club at a suitable portion of the golf club, thus attaching the golf swing training device to the golf club. The golf swing training device when attached to the golf club allows a user to maintain a proper swing orientation and produce a straight swing, thereby preventing slice shot (or slicing of a golf ball).

In an implementation of the invention, a golf swing training device attachable to a golf club may include a main body. The main body may include a front surface configured for the flush resting thereon of a palm of a user's hand, and a back surface opposite the front surface. The golf swing training device may further include at least one clip affixed to and protruding from the back surface of the main body. The at least one clip may include an arcuate portion configured to clip onto a golf club to thereby attach the main body to the golf club. The golf swing training device may be configured to adopt an assembled configuration in which the main body may be arranged adjacent to, spaced-apart from, and extending along a grip portion of a golf club, and further in which the main body may be secured relative to the grip portion by the arcuate portion of each clip of the at least one clip being clipped to the grip portion.

In a second aspect, in the assembled configuration of the golf swing training device, the front surface of the main body may be generally parallel to a central longitudinal axis of the grip portion of the golf club.

In another aspect, the main body may be generally rigid.

In another aspect, the front surface of the main body may be generally flat.

In another aspect, the back surface of the main body may be generally flat.

In yet another aspect, the back and front surfaces of the main body may be generally parallel to one another.

In another aspect, the main body may be generally flat.

In another aspect, the at least one clip may include a pair of clips arranged in spaced-apart relationship with each other.

In another aspect, the pair of clips may be arranged in axial alignment. In the assembled configuration of the golf swing training device, the arcuate portions of the pair of clips may be attached to a rectilinear portion of the grip portion of the golf club.

In yet another aspect, in the assembled configuration of the golf swing training device, the back surface of the main body of the golf swing training device may be spaced apart from the grip portion of the golf club.

In another aspect, the golf swing training device may further include at least one washer plate mountable between the at least one clip and the back surface of the main body to increase a separation between the arcuate portion of the at least one clip and the back surface of the main body.

In another aspect, the at least one clip may include a flange. The arcuate portion may be affixed to the flange. In the assembled configuration of the golf swing training device, the flange of the at least one clip may be affixed to the back surface of the main body, and the arcuate portion of the at least one clip may extend from the flange and rearward and outward of the back surface of the main body.

In another aspect, the flange and arcuate portion may be integrally-formed into a single piece unit.

In yet another aspect, the flange and arcuate portion may be generally perpendicular to one another.

In another aspect, the golf swing training device may further include at least one washer plate mountable between the flange of the at least one clip and the back surface of the main body to increase a separation between the arcuate portion of the at least one clip and the back surface of the main body.

In another aspect, in the assembled configuration of the golf swing training device, the arcuate portion of the at least one clip may extend generally perpendicularly from the back surface of the main body.

In another aspect, the main body may be translucent.

In yet another aspect, the main body may be transparent.

In another aspect, the golf swing training device may include plexiglass.

In one aspect, the front surface may be a planar surface, facilitating a user to place the hand, and in particular, palm of a dominant hand, flush against the front surface.

In another aspect, a user may place the hand flush against the front surface during an entire swinging motion of the golf club.

In another aspect, the clips may be distanced from the back surface by a predetermined distance, the space between the clips and the back surface allowing a user to properly grip the golf club by a non-dominant hand.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
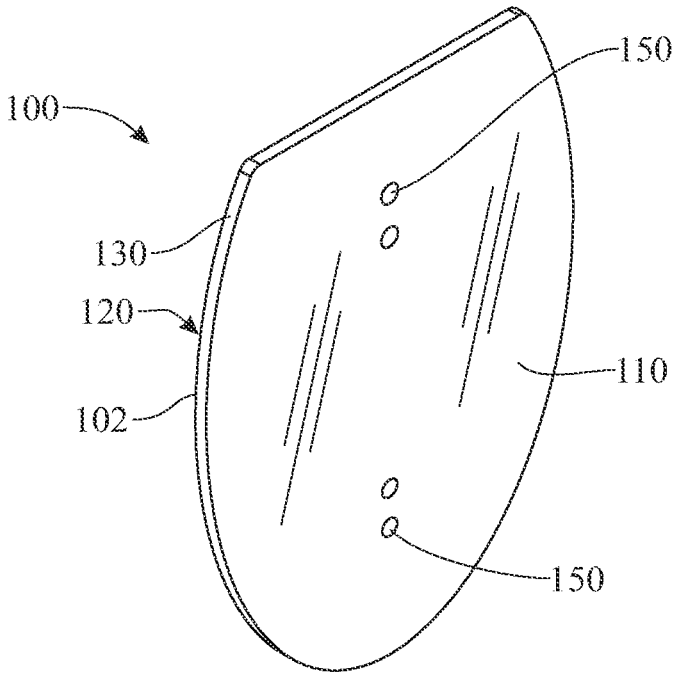
FIG. 1 illustrates a front perspective view of a golf swing training device, in accordance with one embodiment of the present specification.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with vending devices have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

It should be noted that throughout the specification and claims which follow, the term "golf club" is not limited to any specific golf club, rather, the term "golf club" intend to cover all the different varieties of golf clubs that are used in different scenarios in a game.

It should also be noted that throughout the specification and claims which follow, the application of the device is not limited to only right handed users or only left handed users, rather, the device can be used by both right handed and left handed users.

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

Shown throughout the drawings, the present invention is directed toward a golf swing training device that is attachable to a golf club and allows users to produce a straight swing of the golf club and prevent slicing of a golf ball.

Figure 2:
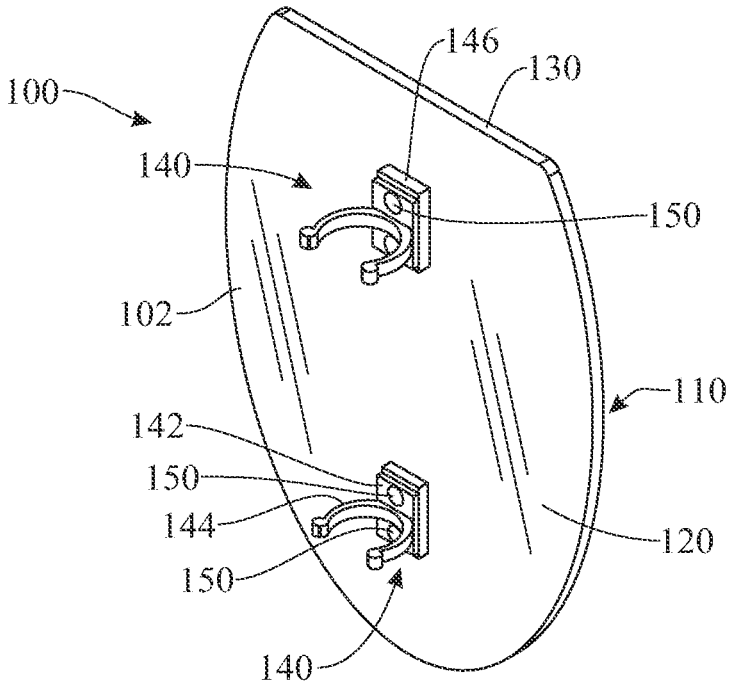
FIG. 2 illustrates a rear perspective view of the golf swing training device, in accordance with one embodiment of the present specification.

Reference is initially made to FIGS. 1 and 2, which illustrate front and rear perspective views, respectively, of a golf swing training device 100 in accordance with one aspect of the presently disclosed subject matter. The golf swing training device 100 comprises a main body 102, which may be formed as a board- or panel-type piece; in some embodiments, the main body 102 may be generally planar or flat, as shown. In preferred embodiments, the main body 102 may be generally rigid, to transfer a force exerted thereon by a hand to a golf club attached to the main body 102, for purposes that will be described in detail hereinafter. The main body 102 may include a front surface 110 and a back surface 120. In some embodiments, such as the present embodiment, the front surface 110 and back surface 120 may be generally parallel to one another. Alternatively or additionally, the front and back surfaces 110 and 120 may be generally planar or flat, as shown.

The front surface 110 and the back surface 120 are adjoined by a rim 130. The front surface 110, back surface 120, and the rim 130 may be integrally and uniformly formed during the manufacturing process of the golf swing training device 100; for example, the main body 102 may be formed into a single-piece or monolithic unit. Alternatively, the front surface 110, the back surface 120, and the rim 130 may be separately formed and joined together by suitable means such as welding or by use of adhesives. In one embodiment, the golf swing training device 100 is integrally formed by a suitable manufacturing process such as molding or heat press.

As seen in FIG. 1, the front surface 110 of the present embodiment is a planar and smooth surface. When the golf swing training device 100 is engaged with a golf club, the front surface 110 allows a user to place a palm of one hand flush on the front surface 110 while the other hand grips the golf club. The golf swing training device 100 is configured so as to allow both right-handed and left-handed users to utilize the golf swing training device 100 with a golf club. For right-handed users (users whose dominant hand is a right hand), the users would place palm of their right hand flush on the front surface 110 while the left hand grips the golf club. For left-handed users (users whose dominant hand is a left hand), the users would place palm of their left hand flush on the front surface 110 while the right hand grips the golf club.

In a preferred embodiment, the main body 102 may be transparent or translucent, i.e. allowing light to pass through and optionally allowing to see through the main body 102. For example, the main body 102 of the golf swing training device 100, including the front surface 110, the back surface 120, and the rim 130, can be manufactured using plexiglass. By use of plexiglass to form the golf swing training device 100, the golf swing training device 100 has a higher impact strength as compared to other transparent or semi-transparent materials such as glass and polyethylene, and at the same time, is lightweight and easily portable by users along with their other equipment. In some embodiments, additional material may be added during manufacturing of the golf swing training device 100 to modify the properties of the golf swing training device 100. For instance, dyes can be added while manufacture of the golf swing training device 100 to impart color to the golf swing training device 100, however, without significantly affecting the light transmittance properties of the golf swing training device 100.

The golf swing training device 100 further includes one or more fasteners configured to secure the main body 102 to a golf club. For example, the golf swing training device 100 depicted herein specifically comprises clips 140 coupled to the back surface 120 of the main body 102 of the golf swing training device 100 and configured to clip onto the golf club and thereby secure the main body 102 to the golf club. The clips 140 may be arranged in spaced-apart relationship, and may be axially aligned such that the clips 140 may clip onto a generally straight body (a grip portion of a golf club), as will be described in detail hereinafter. The clips 140 may be coupled to the main body 102 by means of pins 150, for instance and without limitation. For example, each clip 140 may be coupled by a pair of pins 150. The pins 150 may extend through the main body 102, and more specifically, through the back surface 120 and optionally the front surface 110, thereby securely coupling the clips 140 to the golf swing training device 100.

As can be seen in FIG. 2, each of the clips 140 comprises a flange portion 142 and an arcuate portion 144 fixedly connected to the flange portion 142. As shown, the flange portion 142 may be configured to attach to and remain adjacent to the main body 102, such that the arcuate portion 144 extends generally perpendicularly to the back surface 120 of the main body 102. In embodiments in which the main body 102 is planar, such as the present embodiment, the arcuate portion 144 may extend rearward from the back surface 120 perpendicularly to the planar main body 102. The flange portion 142 and arcuate portion 144 may have a vertical orientation and a horizontal orientation, respectively, when the clip 140 is coupled to the main body 102 of the golf swing training device 100. The flange portion 142 provides a securing portion for the pins 150 to connect the clip 140 to the back surface 120 of the main body 102. The arcuate portion 144 is configured to engage in an elastic or clip-type manner with a golf club, as will be described in detail further below.

In some embodiments, the flange portion 142 and the arcuate portion 144 may be formed uniformly and integrally as a single element. Alternatively, the arcuate portion 144 may be formed separately and connected to the flange portion at a later stage, for instance, during assembly thereof. Further, the golf swing training device 100 may comprise any number of clips 140 that may be required to attach the golf swing training device 100 to the golf club.

As can be seen in FIG. 2, the clips 140 protrude outwards from the back surface 120 of the main body 102. The amount of protrusion of the clips 140 can be determined based on the golf club to which the golf swing training device 100 is to be engaged such that a sufficient space is left between the main body 102 of the golf swing training device 100 and the golf club for a user to grip the golf club, as will be described in detail further below.

A washer plate 146 (also seen in FIG. 5) may additionally be used to facilitate coupling of the clips 140 to the back surface 120 of the main body 102 and preventing the clips 140 from loosening over time. The washer plate 146 serves an additional purpose of increasing the protrusion of the clips 140 further outwards from the back surface 120, thereby providing a greater space for a user to comfortably grip their hand onto the golf club, when the golf swing training device 100 is in engagement with the golf club. It is appreciated that the washer plate 146 may be formed integrally with the clips 140 or may be separately coupled to the clips 140. In embodiments in which the washer plate 146 is separately formed, washer plates 146 of different thicknesses may be interchangeably mounted between the clips 140 and the main body 102 to selectively adjust the separation between the clip 140 and the main body 102 and thereby adjust the protrusion of the clip 140 outwards form the back surface 120.

Figure 3:
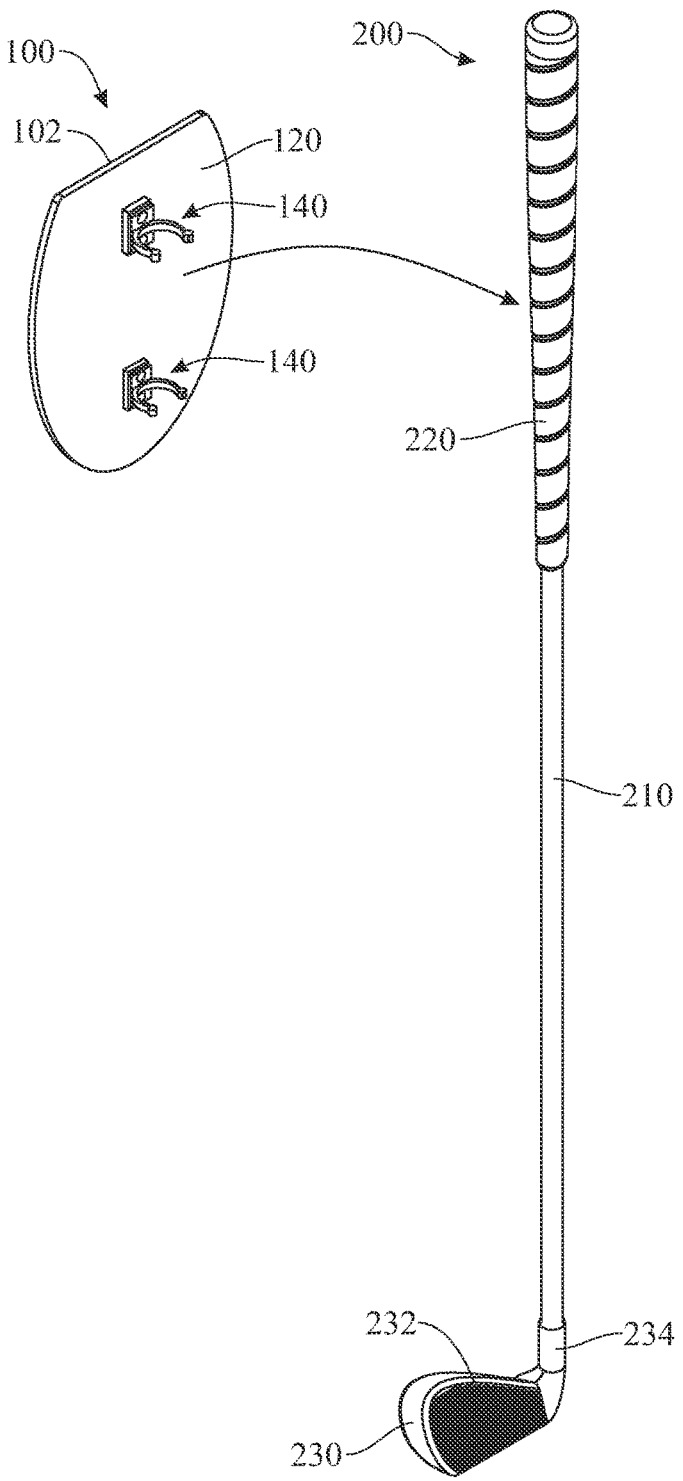
FIG. 3 illustrates a perspective view of a golf club and the golf swing training device, with the golf swing training device being moved to be in attachment with the golf club, in accordance with one embodiment of the present specification.
Figure 4:
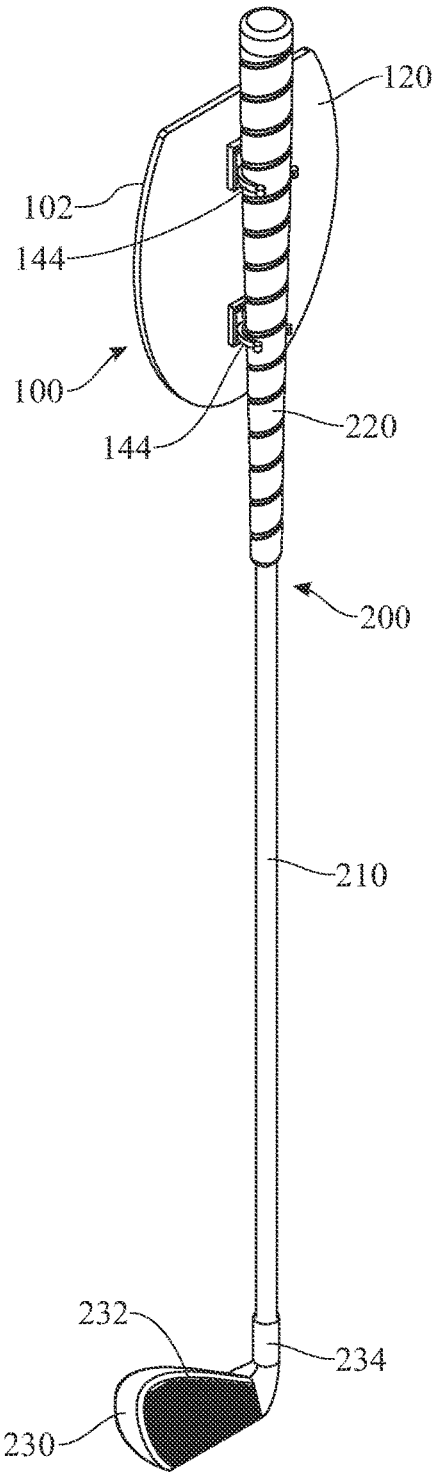
FIG. 4 illustrates a perspective view of the golf club and the golf swing training device, with the golf swing training device in attachment with the golf club, in accordance with one embodiment of the present specification.

Reference is now made to FIGS. 3 and 4 for illustrating the engagement between the golf swing training device 100 and a golf club. The illustration of FIG. 3 shows a golf club 200 to which the golf swing training device 100 is to be engaged with, for instance, at a grip portion of the golf club 200. The illustration of FIG. 4, in turn, shows the golf swing training device 100 in engagement with the golf club 200.

The golf club 200 includes a shaft 210 extending between a grip portion 220 and a head portion 230. The shaft 210 plays an important role in the swing of the golf club 200 by a user by allowing the user to hit a golf ball to different distances by swinging the golf club 200. The grip portion 220 allows a user to hold the golf club 200 in order to produce a swinging motion of the golf club 200. It is appreciated that the grip portion 220 may spread along different lengths along a longitudinal axis of the shaft 210 depending on the type of golf club and how a user intends to grip the golf club 200 via the grip portion 220.

The grip portion 220 may be a layer of material applied over one end of the shaft 210 so as to form the grip portion 220. Alternatively, the grip portion 220 may be separately formed and securely connected to one end of the shaft 210. Any suitable material can be used to form the grip portion 220 that facilitates proper grip for a user during swinging of the golf club 200 as well as to allow secure engagement with the golf swing training device 100. In some non-limiting examples, the materials used to form the grip portion 220 can be leather, rubber, or a polymer.

The head portion 230 is connected at an end of the golf club 200 opposite to the end at which the grip portion 220 is provided. The head portion 230 comprises a striking face 232 that ideally hits a golf ball when a user swings the golf club 200. The head portion 230, and in particular, the striking face 232 may take different configurations depending on the requirements of the user, in that, the head portion and/or striking face 232 may vary in configuration, sizes, dimensions, etc. for different types of golf clubs 200. It is appreciated that the golf clubs usable with the present invention are not limited to the golf club 200 illustrated in FIGS. 3 and 4; for example, the golf club 200 may be any of a driver, an iron, hybrids, a wedge, and a putter.

The head portion 230 depicted herein further includes a sleeve 234, the sleeve 234 being configured to be securely connected to the shaft 210 such that a swinging motion of the shaft 210 is properly transmitted to the head portion 230 when a user strikes a golf ball with the golf club 200. The sleeve 234, and thereby the head portion 230, can be connected to the shaft 210 using any suitable means such as by use of adhesives and/or soldering and or by additional elements like threads and rings.

Figure 6:
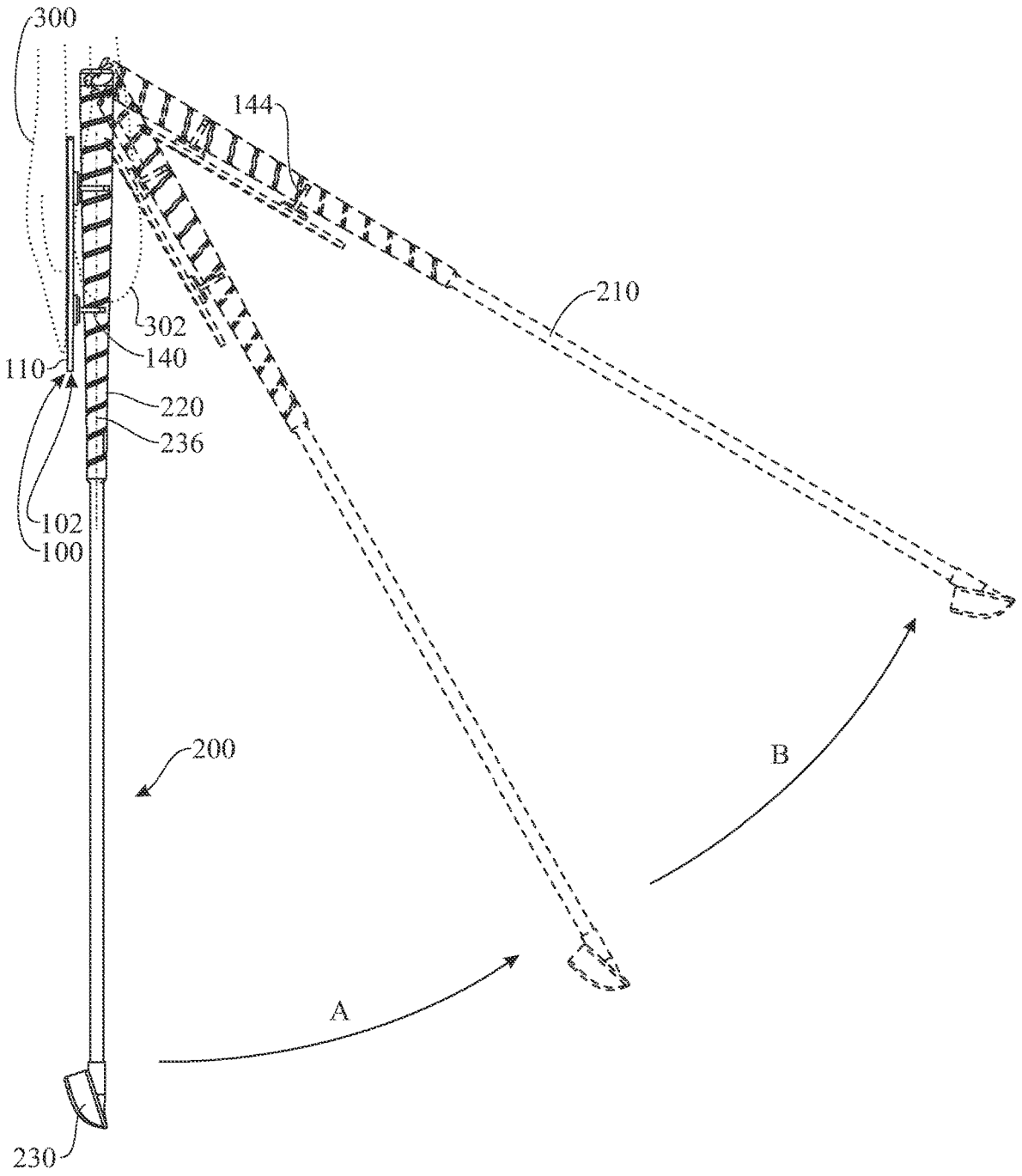
FIG. 6 illustrates a side view of a swinging motion of the golf club with the golf swing training device attached thereto, in accordance with one embodiment of the present specification.

As best seen in FIG. 4, the golf swing training device 100 is in engagement with the golf club 200. In particular, the arcuate portion 144 of each clip 140 is configured to be in a gripping (i.e., clipping) engagement with the grip portion 220 of the golf club 200 whereby the arcuate portion 144 of the clip 140 can be positioned at a suitable location at the grip portion 220 such that the arcuate portion 144 at least partially surrounds the grip portion 220 in a gripping and clipping (i.e., elastic) manner. As best shown in FIG. 6, when the golf swing training device 100 is secured to the golf club 200, the front surface 110 of the main body 102 of the golf swing training device 100 may be generally parallel to a central longitudinal axis 236 of the grip portion 220 of the golf club 200, such that the front surface 110 provides a tactile reference to the position and orientation of the grip portion 220. Alternatively or additionally, and preferably additionally, as shown, the back surface 120 of the main body 102 of the golf swing training device 100 may be generally parallel to the central longitudinal axis 236 of the grip portion 220 of the golf club 200, such that the back surface 120 is spaced-apart a generally constant distance from the generally rectilinear grip portion 220 providing an optimized yet comfortable space for grasping the gripping portion 220 with one hand, as will be described hereinafter.

It is appreciated that the dimensions of the arcuate portion 144 of the clip 140 can be determined based on the dimensions of the grip portion 220 of the golf club 200 to which the arcuate portion 144 is to be coupled/engaged to, so as.to establish a secure and tight engagement between the golf swing training device 100 and the golf club 200. However, the elastic nature of the clip-type connector provided by the arcuate portion 144 may additionally allow the arcuate portion 144 to elastically adjust to grip portions 220 of different dimensions (diameters).

When the golf swing training device 100 is in engagement with the golf club 200 via the clips 140, a user can still use the golf club 200 for playing a game or to do practice. The golf swing training device 100, and in particular, the front surface 110 of the main body 102, provides a planar surface for a user to place a palm of the dominant hand flush on the front surface 110 while the non-dominant hand of the user grips the grip portion 220 of the golf club 200. By virtue of the above configuration, the user is able to swing the golf club 200 (with the golf swing training device 100 engaged therewith) in a straight line, thereby preventing possibilities of slicing the golf ball (i.e., preventing occurrence of the slice shot).

Figure 5:
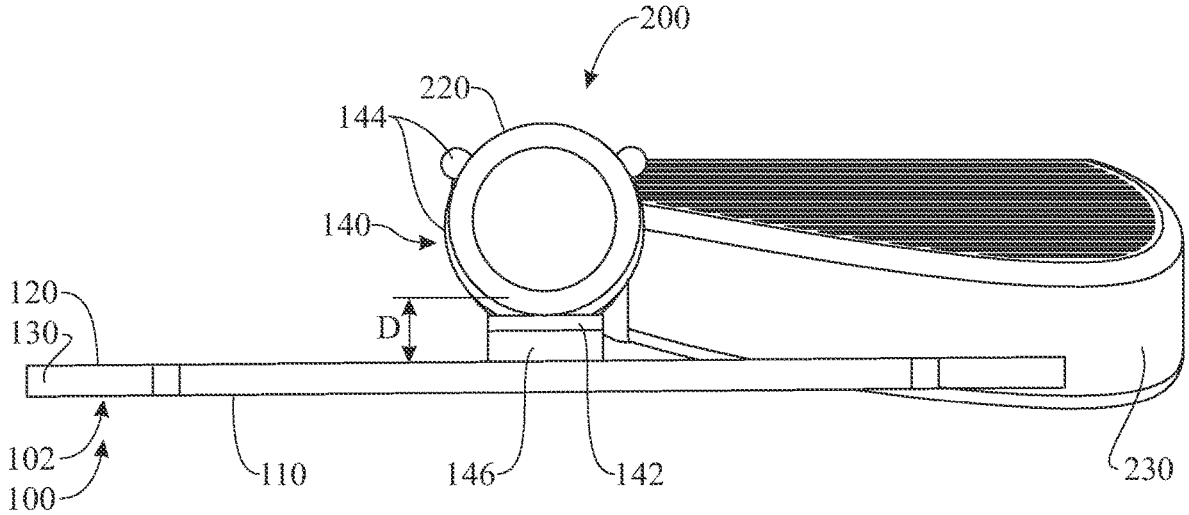
FIG. 5 illustrates a top view of the golf club with the golf swing training device being attached thereto, in accordance with one embodiment of the present specification.

Reference is now made to FIG. 5, which illustrates a top view of the golf club 200 when engaged with the golf swing training device 100. The clips 140, which are attached to the main body 102 and protrude rearward of the back surface 120 of the main body 102, are in gripping engagement with the golf club 200, and in particular with the grip portion 220 of the golf club 200.

Due to the attachment of the clips 140 to the back surface 120 of the main body 102 and to the rearward protruding of the clips 140 relative to the back surface 120, and in some embodiments, due also to the presence of the washer plate 146 to facilitate coupling between the clips 140 and the back surface 120 of the main body 102, the golf swing training device 100 does not interfere when a user grips the grip portion 220 of the golf club with either a right hand or a left hand. As shown in FIG. 5, the golf swing training device 100 is distanced from the grip portion 220 of the golf club 200 a distance D, thereby allowing users to grip the golf club 200 by one hand while placing the other hand flush on front surface 110 of the main body 102. For right handed users, the right hand is placed flush on the front surface 110 of the device and the left hand is used to grip the golf club 200 via the grip portion 220. For left handed users, the left hand is placed flush on the front surface 110 of the device and the right hand is used to grip the golf club 200 via the grip portion 220.

Figure 7:
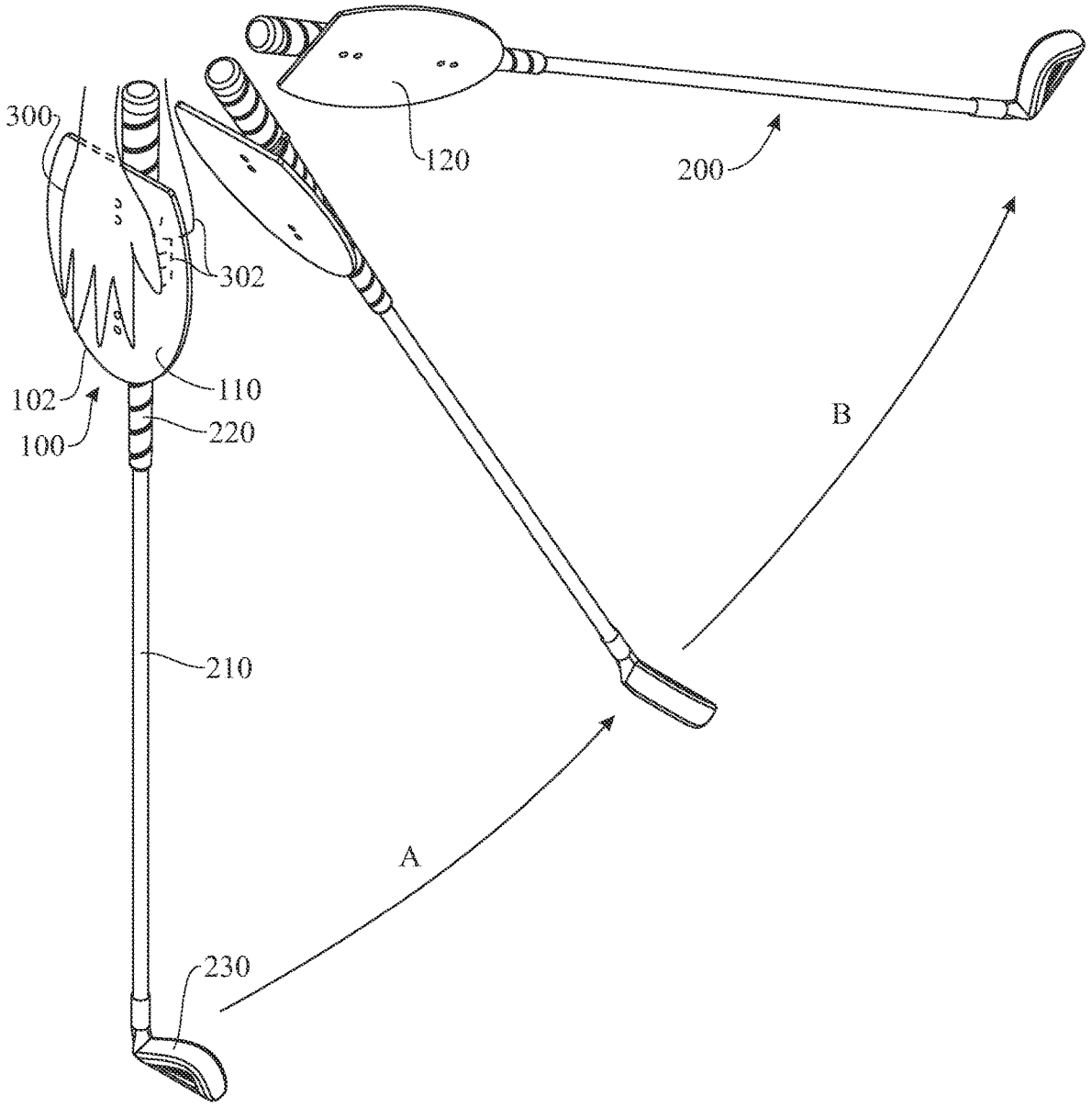
FIG. 7 illustrates an isometric view of a swinging motion of the golf club with the golf swing training device attached thereto, in accordance with one embodiment of the present specification.

Reference is now made to FIGS. 6 and 7, which illustrate a swinging motion of a golf club 200 with the golf swing training device 100 attached thereto. The illustration of FIG. 6 shows a side elevation view of the golf club 200 during a swinging motion by a user (not shown), with the golf swing training device 100 being attached to the golf club 200 via the clips 140. The illustration of FIG. 7, in turn, shows an isometric view of the golf club 200 during a swinging motion by a user (not shown), with the golf swing training device 100 being attached to the golf club 200 via the clips 140.

Initially, the golf club 200 is held vertically by a user, with the palm of one hand 300 of the user flush against the front surface 110 of the main body 102 of the golf swing training device 100, and with the other hand 302 gripping the golf club 200 at the grip portion 220 (rather than gripping the golf club with both hands 300, 302 as is typically done when using the golf club 200 alone). Subsequently, the user swings the golf club 200 as shown by arrows A and B, with the subsequent positions of the golf club 200 during the swinging motion illustrated in broken lines (FIG. 6) and solid lines (FIG. 7). It should be noted that, for clarity purposes, the hands 300, 302 have been depicted using dotted lines in FIG. 6 and solid lines (or hidden lines, where applicable) in FIG. 7.

Since the user places one hand 300 flush against the front surface 110 of the preferably rigid, main body 102 during the entire swinging motion of the golf club 200, the golf club 200 will turn over automatically and cause a golf ball to run up against the head portion 230 of the golf club 200. This results in a straight shot when the head portion 230 of the golf club 200 strikes the golf ball, thus avoiding slicing of the golf ball. By virtue of the golf swing training device 100 allowing a user to place the dominant hand 300 (right hand for right handed users and left hand for left handed users) flush on the front surface 110, the head portion 230 of the golf club 200 squares up at the bottom of the swinging motion, thus producing a straight shot.

The golf swing training device 100 attached to the golf club 200 promotes a swing to a target point where a golf ball is intended to be hit. In absence of the golf swing training device 100, users most often strike a golf ball with a glancing motion, causing a side spin on the golf ball. Due to the spin on the golf ball, the golf ball moves in the air and swings away from a target point resulting in a slice.

The golf swing training device 100 further assists in indicating that the user has not struck the ball in an ideal manner, rather, the user has produced a slice of the golf ball. During a swinging motion of the golf club 200, the user rests the dominant hand 300 flush against the golf swing training device 100. In an ideal scenario, the dominant hand 300 stays flush against the golf swing training device 100 (i.e. against the front surface 110 of the main body 102) during the entire swinging motion of the golf club 200. In case the dominant hand 300 comes off from the front surface 110 of the main body 102 during the swinging motion of the golf club 200, the user can assume that the golf club 200 has not struck the golf ball ideally, and that a slice shot has instead been produced and the golf ball will move away from a target point.

The golf swing training device 100 solves an important problem pertinent in the golf club swings by allowing users to swing the golf club 200 in a straight line such that no slice is produced. For instance, users can attach the golf swing training device 100 to a golf club 200 during training to repeatedly practice a straight swing of the golf club 200. Right handed users place their dominant right hand 300 flush against the golf swing training device 100 while left handed users place their dominant left hand 300 flush against the golf swing training device 100. The users can practice swinging the golf club 200 in a straight line so as to prevent slicing of the golf ball by keeping the dominant hand 300 flush against the golf swing training device 100 during the entire swinging motion of the golf club 200.

The golf swing training device 100 allows a user to naturally release the golf club 200 through a target line, i.e., a line between the golf ball and a target point. By virtue of the golf swing training device 100, a user is facilitated in maintaining a proper swinging motion of the golf club 200. Additionally, the golf swing training device 100 facilitates a user to apply uniform pressure on the golf swing training device 100 and enables continuous rotation of the head portion 230 to be squared at the bottom of the swinging motion.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A golf swing training device attachable to a golf club, the golf swing training device comprising:

a main body, comprising a front surface configured for flush resting thereon of a palm of a user's hand, the main body further comprising a back surface opposite the front surface; and at least one clip affixed to and protruding from the back surface of the main body, the at least one clip comprising an arcuate portion configured to clip onto a golf club to thereby attach the main body to the golf club; wherein the golf swing training device is configured to adopt an assembled configuration in which the main body is arranged adjacent to, spaced-apart from, and extending along a grip portion of a golf club, and further in which the main body is secured relative to the grip portion by the arcuate portion of each clip of the at least one clip being clipped to the grip portion; and wherein the at least one clip comprises a flange, the arcuate portion affixed to said flange, and further wherein, in the assembled configuration of the golf swing training device, the flange of the at least one clip is affixed to the back surface of the main body and the arcuate portion of the at least one clip extends from the flange and extends rearward and outward of the back surface of the main body; and further comprising at least one washer plate mountable between the flange of the at least one clip and the back surface of the main body to increase a separation between the arcuate portion of the at least one clip and the back surface of the main body.

2. The golf swing training device of claim 1, wherein, in the assembled configuration of the golf swing training device, the front surface of the main body is generally parallel to a central longitudinal axis of the grip portion of the golf club.

3. The golf swing training device of claim 1, wherein the main body is generally rigid.

4. The golf swing training device of claim 1, wherein the front surface of the main body is generally flat.

5. The golf swing training device of claim 1, wherein the back surface of the main body is generally flat.

6. The golf swing training device of claim 1, wherein the back and front surfaces of the main body are generally parallel to one another.

7. The golf swing training device of claim 1, wherein the main body is generally flat.

8. The golf swing training device of claim 1, wherein the at least one clip comprises a pair of clips arranged in spaced-apart relationship with each other.

9. The golf swing training device of claim 8, wherein the pair of clips are arranged in axial alignment, and further wherein, in the assembled configuration of the golf swing training device, the arcuate portions of the pair of clips are attached to a rectilinear portion of the grip portion of the golf club.

10. The golf swing training device of claim 1, wherein, in the assembled configuration of the golf swing training device, the back surface of the main body of the golf swing training device is spaced apart from the grip portion of the golf club.

11. The golf swing training device of claim 1, wherein the flange and arcuate portion are integrally-formed into a single piece unit.

12. The golf swing training device of claim 1, wherein the flange and arcuate portion are generally perpendicular to one another.

13. The golf swing training device of claim 1, wherein, in the assembled configuration of the golf swing training device, the arcuate portion of the at least one clip extends generally perpendicularly from the back surface of the main body.

14. The golf swing training device of claim 1, wherein the main body is translucent.

15. The golf swing training device of claim 1, wherein the main body is transparent.

16. A golf swing training device attachable to a golf club, the golf swing training device comprising:

a generally rigid and flat, main body, comprising a front surface configured for flush resting thereon of a palm of a user's hand, the main body further comprising a back surface opposite and parallel to the front surface; and at least one clip affixed to and protruding from the back surface of the main body, the at least one clip comprising an arcuate portion configured to clip onto a golf club to thereby attach the main body to the golf club; wherein the golf swing training device is configured to adopt an assembled configuration in which the main body is arranged adjacent to, spaced-apart from, and extending along a grip portion of a golf club, and further in which the main body is secured relative to the grip portion by the arcuate portion of each clip of the at least one clip being clipped to the grip portion; and further comprising at least one washer plate mountable between the at least one clip and the back surface of the main body to increase a separation between the arcuate portion of the at least one clip and the back surface of the main body.

17. A golf swing training device attachable to a golf club, the golf swing training device comprising:

a generally rigid and flat, main body, comprising a front surface configured for flush resting thereon of a palm of a user's hand, the main body further comprising a back surface opposite and parallel to the front surface; and a pair of clips affixed to and protruding from the back surface of the main body, each clip comprising an arcuate portion extending rearward and perpendicularly relative to the back surface of the main body and configured to clip onto a golf club to thereby attach the main body to the golf club; wherein the golf swing training device is configured to adopt an assembled configuration in which the main body is arranged adjacent to, spaced-apart from, and extending along a grip portion of a golf club, with the back surface of the main body spaced apart from the grip portion, and further in which the main body is secured relative to the grip portion by the arcuate portion of each clip of the pair of clips being clipped to the grip portion; and further comprising at least one washer plate mountable between the at least one clip and the back surface of the main body to increase a separation between the arcuate portion of the at least one clip and the back surface of the main body.

* * * * *